US007421759B2

(12) United States Patent
Michael et al.

(10) Patent No.: US 7,421,759 B2
(45) Date of Patent: Sep. 9, 2008

(54) VACUUM EXTRACTION APPARATUS FOR CLEANING A SURFACE

(75) Inventors: William J. Michael, Chino Valley, AZ (US); Reed A. Davis, Prescott, AZ (US)

(73) Assignee: Northland Products, Inc., Chino Valley, AR (US)

( * ) Notice: Subject to any disclaimer, the term of this patent is extended or adjusted under 35 U.S.C. 154(b) by 681 days.

(21) Appl. No.: 11/003,151

(22) Filed: Dec. 3, 2004

(65) Prior Publication Data

US 2006/0117517 A1 Jun. 8, 2006

(51) Int. Cl.
*A47L 7/00* (2006.01)

(52) U.S. Cl. ..... 15/320; 15/321; 15/323; 15/334

(58) Field of Classification Search ..... 15/320, 15/321, 323, 334
See application file for complete search history.

(56) References Cited

U.S. PATENT DOCUMENTS

| | | | | |
|---|---|---|---|---|
| 4,167,799 | A | 9/1979 | Webb | |
| 4,356,590 | A | 11/1982 | Goldsmith | |
| 4,809,397 | A * | 3/1989 | Jacobs et al. | 15/320 |
| 4,893,375 | A * | 1/1990 | Girman et al. | 15/321 |
| D318,543 | S | 7/1991 | Shero | |
| D337,184 | S | 7/1993 | Bothun et al. | |
| D377,855 | S | 2/1997 | Labarbera | |
| 5,657,509 | A * | 8/1997 | Trautloff et al. | 15/321 |
| D404,859 | S | 1/1999 | Dziersk et al. | |
| 6,082,376 | A * | 7/2000 | Karr et al. | 134/6 |
| 6,088,873 | A | 7/2000 | Pacchini et al. | |
| 6,138,322 | A * | 10/2000 | Crouser et al. | 15/337 |
| 6,368,373 | B1 | 4/2002 | Mueller | |
| 6,425,958 | B1 | 7/2002 | Giddings et al. | |
| D477,444 | S | 7/2003 | Bisson | |
| 7,272,869 | B1 * | 9/2007 | Robinson | 15/320 |

OTHER PUBLICATIONS

"Sanitaire Commercial Canister Carpet Cleaner" http://www.kleenkuip.com/portables/sanitaire_SC6080.htm, Oct. 25, 2004.

* cited by examiner

*Primary Examiner*—Joseph J. Hail, III
*Assistant Examiner*—Shantese L McDonald
(74) *Attorney, Agent, or Firm*—Jordan M. Meschkow; Lowell W. Gresham; Charlene R. Jacobsen

(57) ABSTRACT

An apparatus (20) for cleaning a surface (22) includes a clean fluid tank (26) containing a cleaning fluid (46) and configured for delivery of the fluid (46) to the surface (22). The clean fluid tank (26) has a first outer surface (76). A waste fluid tank (30) is coupled with the clean fluid tank (26) and has a second outer surface (78). The second surface (78) abuts the first surface (76) to form a conduit (84) between the first and second surfaces (76, 78), the conduit (84) being in fluid communication with the waste fluid tank (30). Vacuum motors (94) and (108), in communication with the conduit (84), operate to vacuum waste fluid (164) and air (116) into the waste fluid tank (30). The air (116) is expelled from the waste fluid tank (30) via the conduit (84).

18 Claims, 6 Drawing Sheets

FIG. 1

20

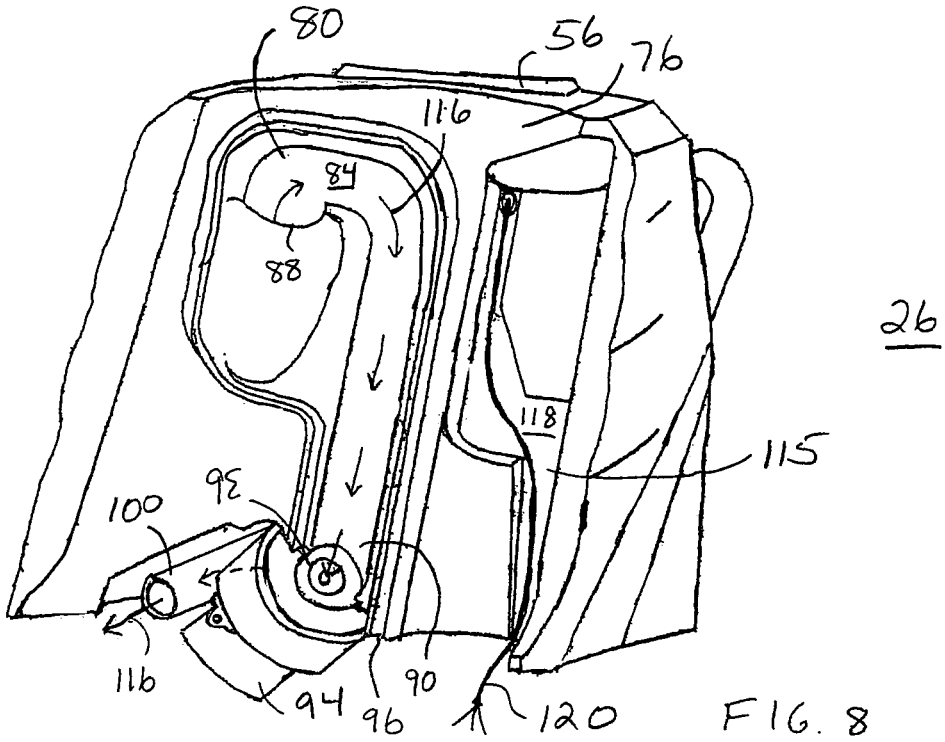
FIG. 8
FIG. 9
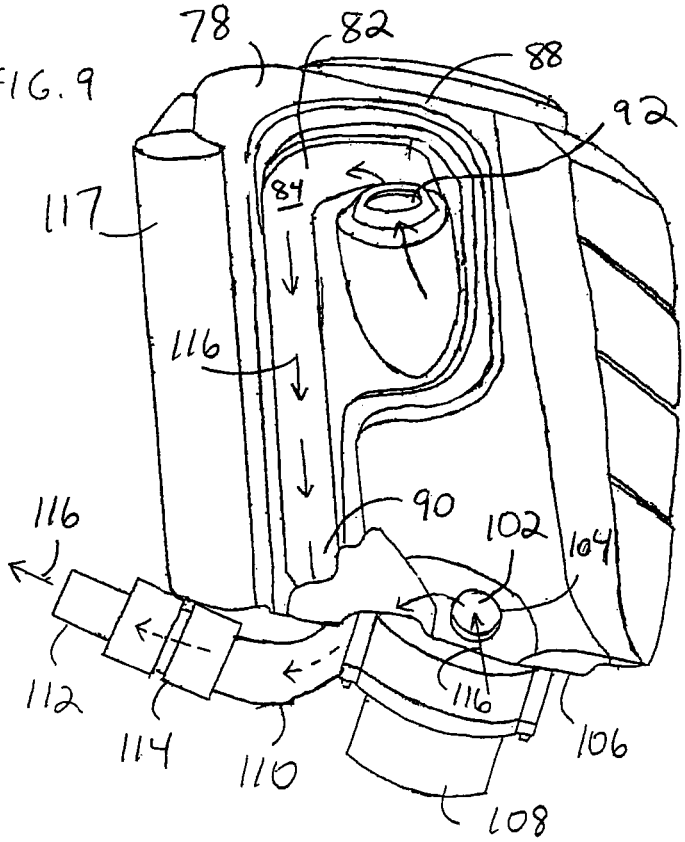
FIG. 10
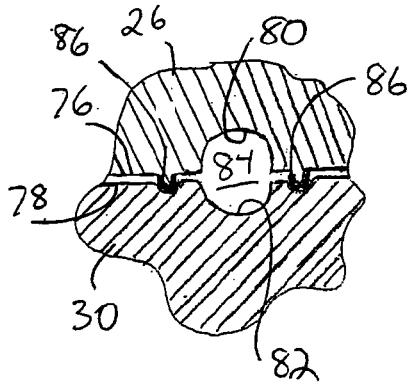

24

VACUUM EXTRACTION APPARATUS FOR CLEANING A SURFACE

TECHNICAL FIELD OF THE INVENTION

The present invention relates to the field of cleaning equipment. More specifically, the present invention relates to vacuum extractors for cleaning carpet.

BACKGROUND OF THE INVENTION

Cleaning carpet and other surfaces enhances the appearance and extends the life of such surfaces by removing the soil embedded in the surface. Moreover, carpet cleaning removes allergens, such as mold, mildew, pollen, pet dander, dust mites, and bacteria. Indeed, regular cleaning keeps allergen levels low and thus contributes to an effective allergy avoidance program.

Vacuum extractors for cleaning surfaces, such as carpet, typically deposit a cleaning fluid upon the carpet or other surface to be cleaned. The deposited fluid, along with soil entrained in the fluid, is subsequently removed by high vacuum suction. This enables the carpet to be almost dry following cleaning, and to be completely dry before mold has time to grow. The soiled fluid, i.e., waste fluid, is then separated from the working air and is collected in a waste tank.

Due to the prevalence of carpeted surfaces in commercial establishments, institutions, and residences, there exists a thriving commercial carpet cleaning industry. In order to maximize the efficacy of the cleaning process, commercial vacuum extractors should be powerful to minimize the time in which the soil entrained cleaning fluid is present in the carpet. Commercial vacuum extractors should also be durable. That is, such a vacuum extractor should be manufactured from durable working parts so that the extractor has a long working life and requires little maintenance. Unfortunately, the cost of a high powered and durable machine can rise significantly if not designed cost effectively.

Individuals working in the carpet cleaning industry are subject to the undesirably loud noise produced by the vacuum motors of conventional vacuum extractors. In addition, some conventional vacuum extractors include fans mounted near internally housed pumps, vacuum motors, and pre-heaters. The fans function to expel air that has been heated by the internal mechanisms from the housing in which they are positioned. Unfortunately, the fans further contribute to the noise produced by conventional vacuum extractors. At best, this noise is annoying. More critically however, continued exposure to noise above 85 decibels (dB), such as that produced by conventional vacuum extractors, can lead to hearing damage and eventual hearing loss at certain frequencies.

Accordingly, what is needed is an apparatus for cleaning a surface that is cost effectively designed while being both high powered and durable. In addition, what is needed is a vacuum extractor in which the noise produced by the vacuum motors is muffled, particularly with high frequency components reduced.

SUMMARY OF THE INVENTION

Accordingly, it is an advantage of the present invention that an apparatus for cleaning a surface is provided.

It is another advantage of the present invention that an apparatus is provided for cleaning a surface by high powered vacuum extraction.

Another advantage of the present invention is that a vacuum extraction apparatus is provided that is durable and cost effectively designed.

Yet another advantage of the present invention is that a vacuum extraction apparatus is provided in which the noise produced by the vacuum motor is muffled.

The above and other advantages of the present invention are carried out in one form by an apparatus for cleaning a surface. The apparatus includes a first tank adapted to contain a fluid and configured for delivery of the fluid to the surface. The first tank includes a first outer surface. A second tank is coupled to the first tank and has a second outer surface. The second outer surface abuts the first outer surface to form a conduit between the first and second outer surfaces, the conduit being in fluid communication with the second tank. A motor is in communication with the conduit and is configured to vacuum the fluid combined with air from the surface for receipt into the second tank. The air is expelled from the second tank via the conduit.

The above and other advantages of the present invention are carried out in another form by an apparatus for cleaning a surface. The apparatus includes a first tank adapted to contain a fluid and a fluid delivery port in fluid communication with said first tank. The fluid deliver port is configured for attachment of a sprayer hose for delivering the fluid from the first tank to the surface. A heater is interposed between the first tank and the fluid delivery port. The apparatus further includes a second tank and a motor in communication with the second tank, the motor being configured to vacuum the fluid from the surface for receipt into the second tank. The motor receives power from an external source, and the apparatus includes means for occasionally switching the power from the motor to the heater to energize the heater.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 8 shows a perspective view of the clean fluid tank of FIG. 4 revealing a first outer surface;

FIG. 9 shows a perspective view of the waste fluid tank of FIG. 4 revealing a second outer surface for abutment with the first outer surface of the first tank;

FIG. 10 shows a partial cross-sectional view of the abutment of the clean fluid and waste fluid tanks of FIGS. 8 and 9;

DETAILED DESCRIPTION OF THE PREFERRED EMBODIMENTS

Figure 1:
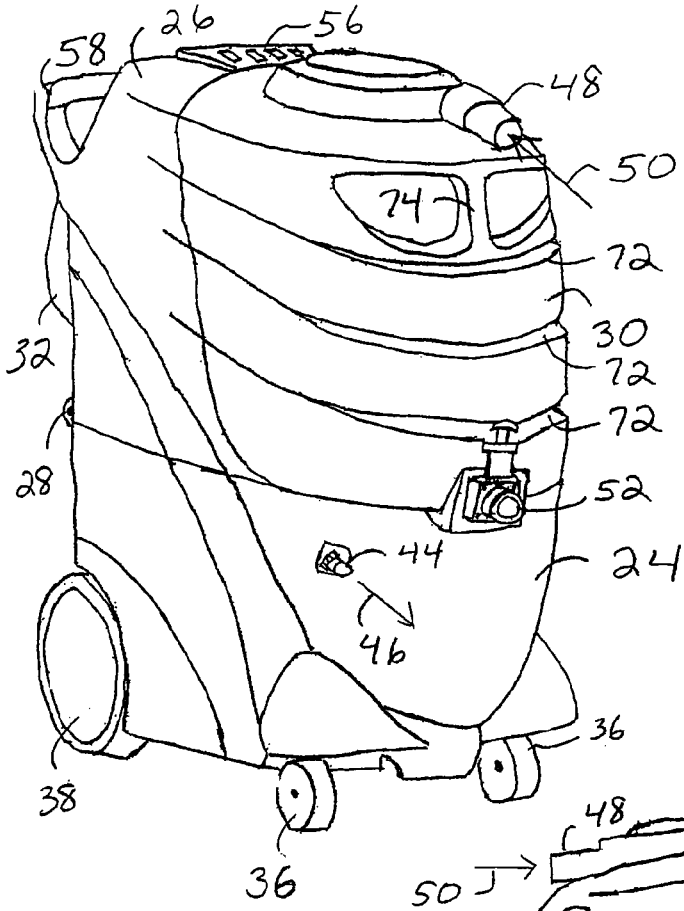
FIG. 1 shows a perspective view of a vacuum extraction apparatus for cleaning a surface in accordance with a preferred embodiment of the present invention.
Figure 2:
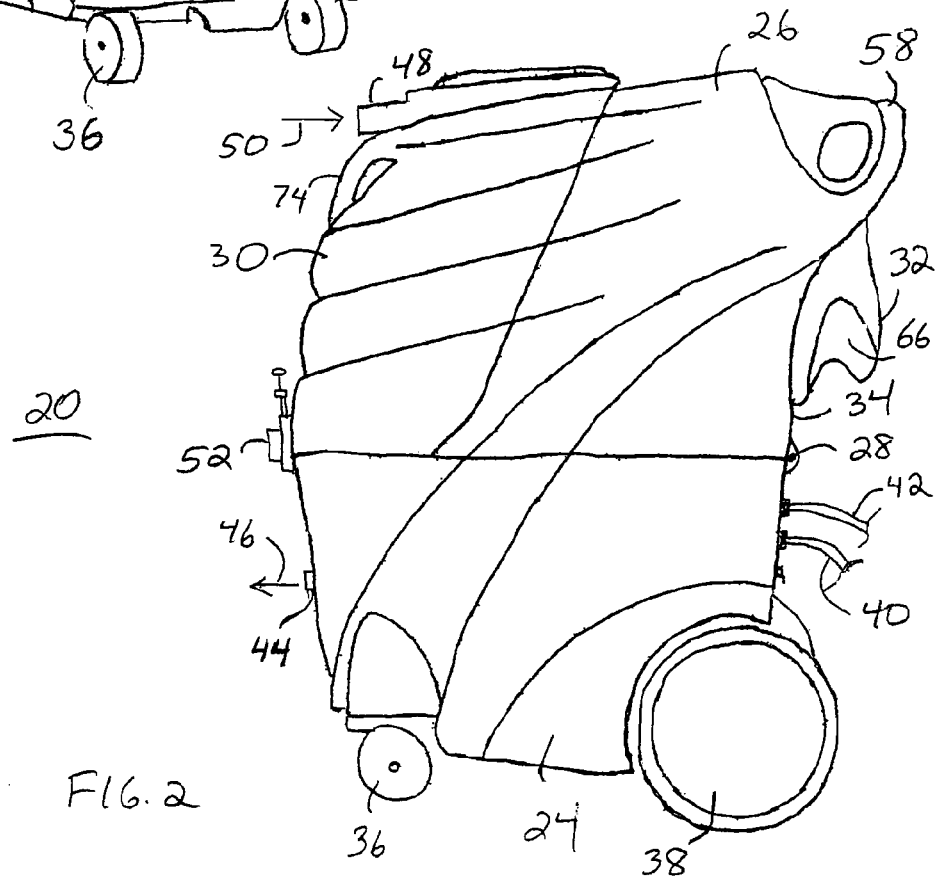
FIG. 2 shows a side view of the vacuum extraction apparatus.
Figure 3:
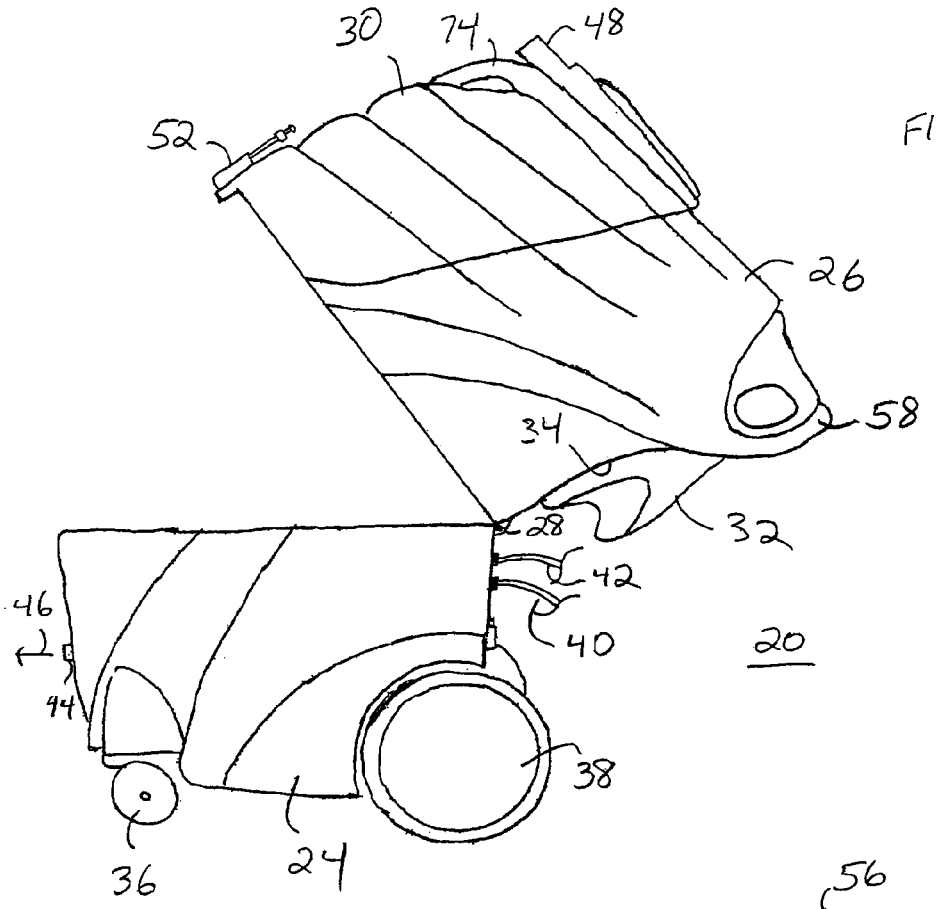
FIG. 3 shows a side view of the vacuum extraction apparatus in an open position.

Referring to FIGS. 1-3, FIG. 1 shows a perspective view of a vacuum extraction apparatus 20 for cleaning a surface 22 (FIG. 14) in accordance with a preferred embodiment of the present invention. FIG. 2 shows a side view of vacuum extraction apparatus 20, and FIG. 3 shows a side view of apparatus 20 in an open position. Apparatus 20 is configured as a suitcase type carpet cleaner/extractor, and may be utilized in commercial carpet cleaning applications. Vacuum extraction apparatus 20 includes a base 24, a first tank 26 pivotally coupled to base 24 via a pivot hinge 28, and a second tank 30 coupled with first tank 26. A tool compartment 32 may be coupled to a rear surface 34 of first tank 26.

Base 24 includes caster-type front wheels 36 and large rear wheels 38 for ease of maneuverability. Internal mechanisms (discussed below) are housed in base 24. A first electrical cord 40 and a second electrical cord 42 extend into base 24 to power the internal mechanisms. Base 24 further includes a fluid delivery port 44 from which a cleaning fluid, represented by an arrow 46, is provided to a cleaning wand (discussed below).

First tank 26 is adapted to contain cleaning fluid 46. Thus, for clarity of understanding, first tank 26 is referred to hereinafter as clean fluid tank 26. Cleaning fluid 46 may be water or a suitable cleaning solution. Second tank 30 includes a fluid inlet 48 to which a vacuum hose of the cleaning wand couples. Second tank 30 receives a mixture of soiled cleaning fluid and air, represented by an arrow 50, at fluid inlet 48. Thus, for clarity of understanding, second tank 30 is referred to hereinafter as waste fluid tank 30. Waste fluid tank 30 may subsequently be emptied via a dump valve 52.

In a preferred embodiment, base 24, clean fluid tank 26, waste fluid tank 30, and tool compartment 32 are formed from a durable plastic material, such as polyethylene. A preferred manufacturing method for base 24, clean fluid tank 26, and waste fluid tank 30 is rotational molding. Rotational molding, also known as rotational casting, is a method for molding hollow plastic objects by placing finely divided particles in a hollow mold that is rotated about two axes, exposing it to heat and then to cold. A rotational molding technique and polyethylene are preferred due to their cost effectiveness. However, those skilled in the art will recognize that other manufacturing methodologies, such as blow molding, may be employed, and other materials may alternatively be selected.

Figure 4:
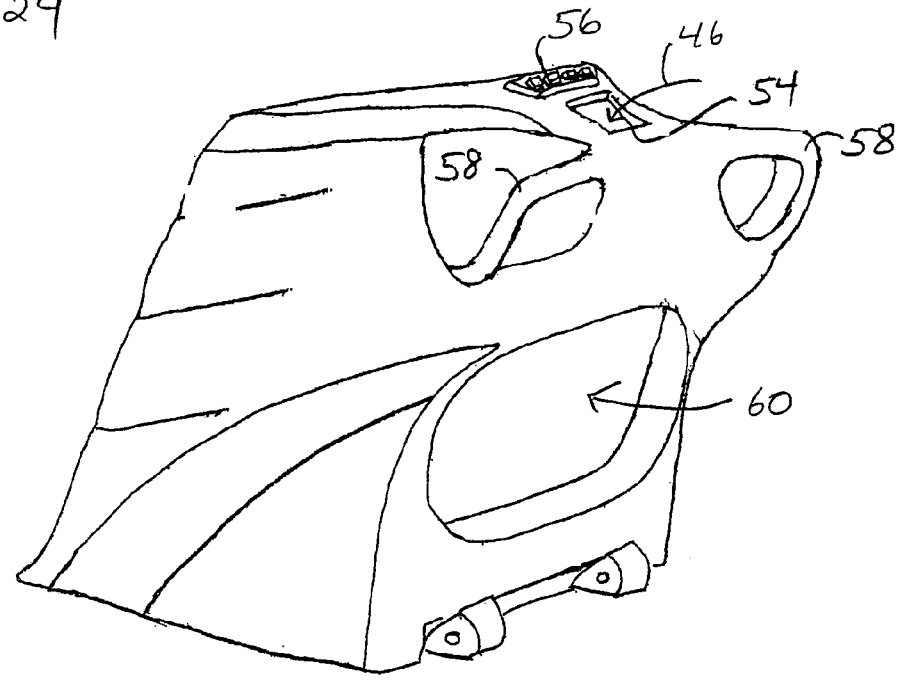
FIG. 4 shows a rear perspective view of a clean fluid tank for the vacuum extraction apparatus.

Referring to FIG. 4 in connection with FIGS. 1-3, FIG. 4 shows a rear perspective view of clean fluid tank 26. Clean fluid tank 26 is a generally rounded and substantially closed container having an opening 54 which is used to fill clean fluid tank 26 with cleaning fluid 46. A control panel 56 is further positioned on clean fluid tank 26. Control panel 56 includes the appropriate switches for operating the internal mechanisms (discussed below) located in base 24. Exemplary switches of control panel 56 may include a fluid delivery pump switch, vacuum motor switches, and the like, known to those skilled in the art. Clean fluid tank 26 further includes molded handles 58 that may be utilized by the operator to maneuver apparatus 20. A receptacle 60 is molded into rear surface 34 of clean fluid tank 26. Receptacle 60 is adapted to receive a matching protrusion section of tool compartment 32.

Figure 5:
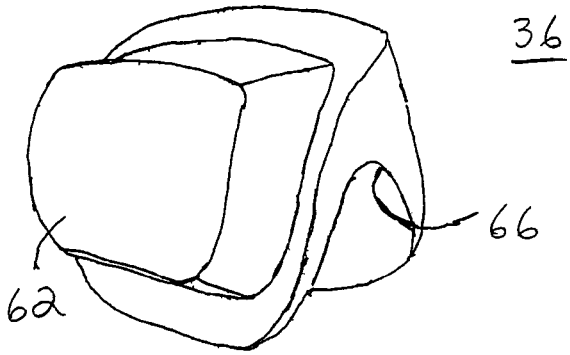
FIG. 5 shows a rear perspective view of a tool compartment attachable to the first tank of FIG. 4.
Figure 6:
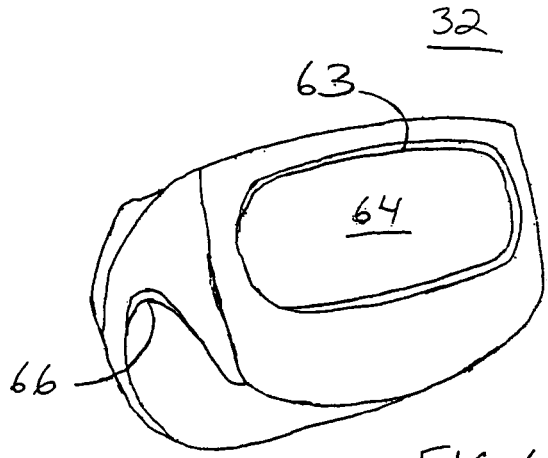
FIG. 6 shows a front perspective view of the tool compartment.

Referring to FIGS. 5-6, FIG. 5 shows a rear perspective view of tool compartment 32 attachable to clean fluid tank 26 (FIG. 4), and FIG. 6 shows a front perspective view of tool compartment 32. As shown in FIG. 5, tool compartment 32 includes a molded protrusion section 62. Protrusion section 62 seats in receptacle 60 (FIG. 4) of clean fluid tank 26 (FIG. 4). Tool compartment 32 includes an opening 63 into a cavity 64. Tools, gloves, spot cleaner, and the like may be stored in cavity 64. In addition, tool compartment 32 includes a grooved lower section 66. As best seen in FIG. 2, first and second electrical cords 40 and 42, respectively, may be wrapped over handles 58 and around grooved lower section 66. Although the internal mechanisms (discussed below) are powered utilizing two power cords, i.e., first and second electrical cords 40 and 42, respectively, it should be understood that the present invention may be alternatively powered utilizing one electrical cord, or more than two electrical cords. Any of the one or more electrical cords may be wrapped over handles 58 and around grooved lower section 66.

Figure 7:
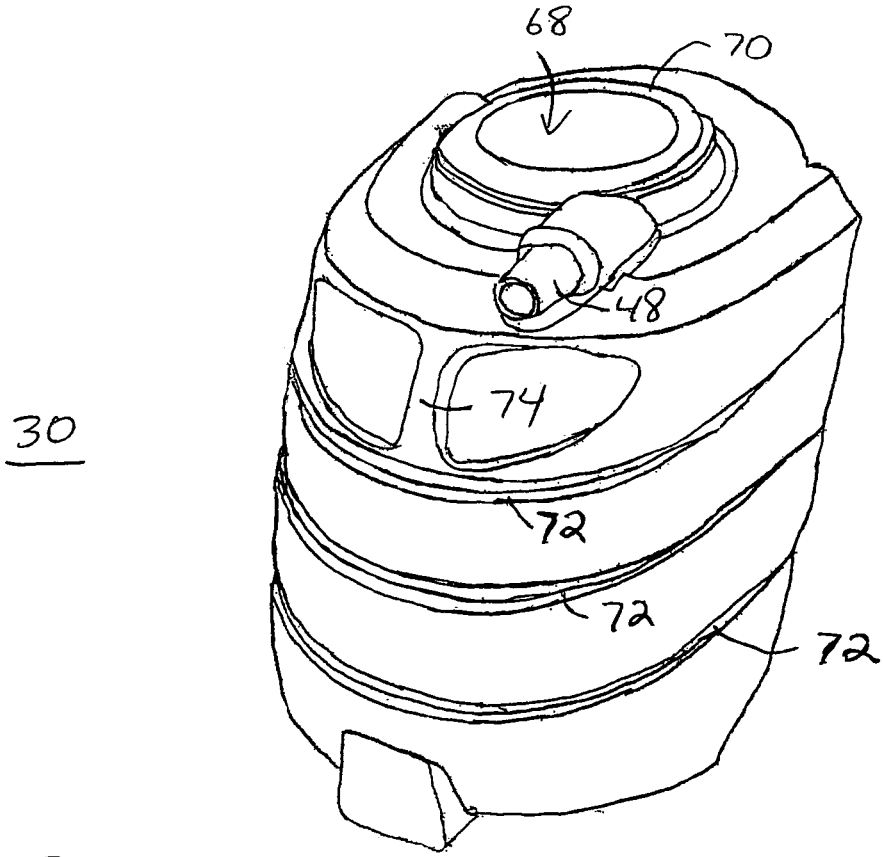
FIG. 7 shows a front perspective view of a waste fluid tank for the vacuum extraction apparatus.

Referring to FIG. 7 in connection with FIGS. 1-3, FIG. 7 shows a front perspective view of waste fluid tank 30. Waste fluid tank 30 is a generally rounded and substantially closed container which may include an opening 68 which can be used to clean out waste fluid tank 30 or to pour out any residual fluid remaining in waste fluid tank 30. A screw-on lid 70 located in opening 68 encloses the interior of waste fluid tank 30 from the surrounding environment. Fluid inlet 48 is a generally cylindrical tube that extends from the front upper surface of waste fluid tank 30. Fluid inlet 48 is adapted to be engaged with a vacuum hose (not shown).

Waste fluid tank 30 further includes externally molded rib members 72 generally encircling the waste fluid tank 30. Since waste fluid tank 30 is sealed from the surrounding environment, it is subject to significant vacuum from the vacuum motors (discussed below) of apparatus 20 (FIG. 1). The shape of waste fluid tank 30 and the inclusion of rib members 72 provide strength to waste fluid tank 30 so as to avoid tank collapse when subjected to this vacuum.

The external appearance of waste fluid tank 30 is also characterized by a molded handle 74 located near the top front surface of waste fluid tank 30. This molded handle 74 may be utilized as a tie-down location for transporting apparatus 20 or may otherwise be utilized to facilitate lifting of waste fluid tank 30.

Referring to FIGS. 8-10, FIG. 8 shows a perspective view of clean fluid tank 26 revealing a first outer surface 76, and FIG. 9 shows a perspective view of waste fluid tank 30 revealing a second outer surface 78 for abutment with first outer surface 76. FIG. 10 shows a partial cross-sectional view of the abutment of clean fluid and waste fluid tanks 26 and 30, respectively. The term "outer surface" refers to exposed surfaces of clean fluid and waste fluid tanks 26 and 30 when waste fluid tank 30 is not coupled with clean fluid tank 26. However, once tank 30 is coupled with tank 26, first and second outer surfaces 76 and 78, respectively, are no longer exposed.

In an exemplary embodiment, clean fluid tank 26 has a first channel 80 formed on first outer surface 76. Waste fluid tank 30 has a second channel 82 correspondingly formed on second outer surface 78. Second channel 82 mates with first channel 80 to form a conduit 84 when waste fluid tank 30 abuts clean fluid tank 26. That is, corresponding tongue and groove members surrounding first and second channels 80 and 82, respectively, seat together to form a fully enclosed conduit 84.

A gasket 86 may optionally be positioned between first and second outer surfaces 76 and 78, about a periphery of first and second channels 80 and 82, to fully seal conduit 84 from the surrounding environment. However, those skilled in the art will recognize that other means may be employed for sealing conduit 84 from the surrounding environment, such as a caulking material, adhesive, and/or other such sealants.

Although each of first and second outer surfaces 76 and 78, respectively, of clean fluid tank 26 and waste fluid tank 30 have a corresponding one of first and second channels 80 and 82, it should be understood that the channels can take on a variety of shapes to form conduit 84. For example, a channel may be formed in only one of first and second outer surfaces 76 and 78, respectively, while the mating one of first and second outer surfaces 76 and 78 may be generally smooth, or flat. In addition, the cross-sectional appearance of the channel portion need not be half-circular but may instead be a square channel, a tapered channel, or the like appropriate to the specific shape of the tanks and the location-of the internal mechanisms (discussed below) of vacuum extraction apparatus 20.

Conduit 84 includes a first end 88 and a second end 90. First end 88 of conduit 84 is in communication with an interior of waste fluid tank 30 via a tank outlet 92. A first vacuum motor 94 is coupled to a first underside 96 of clean fluid tank 26. In addition, when apparatus 20 is assembled, approximately half of first vacuum motor 94 resides underneath waste fluid tank 30. A suction inlet 98 of first vacuum motor 94 is in communication with second end 90 of conduit 84.

An air outlet 100 of first vacuum motor 94 is in communication with a second conduit 102 of waste fluid tank 30. In an exemplary embodiment, second conduit 102 is a generally elbow shaped tunnel integrally molded into waste fluid tank 30. That is, second conduit 102 has an inlet 104 located in second outer surface 78, and an outlet (not visible) located on a second underside 106 of waste fluid tank 30. Although second conduit 102 is shown as being integrally molded into waste fluid tank 30, it should be understood that the formation of second conduit 102 can be shared between clean and waste fluid tanks 26 and 30, respectively, with the object being to keep second conduit 102 as short as possible.

A second vacuum motor 108 is coupled to second underside 106 of waste fluid tank 30. Second vacuum motor 108 has a suction inlet (not visible) in communication with the outlet of second conduit 102. An air outlet 110 of second vacuum motor 108 is in communication with an exhaust conduit 112, and exhaust conduit 112 includes a muffler 114. In a preferred embodiment, muffler 114 is a non-restrictive muffler for enhanced exhaust flow.

First and second vacuum motors 94 and 108, respectively, operate in series to provide suction to expel air, represented by arrows 116, that is carried in mixture 50 (FIG. 1) from waste fluid tank 30. More specifically, when first and second vacuum motors 94 and 108 are activated, air 116 is drawn by the suction of first and second vacuum motors 94 and 108 through tank outlet 92 and into conduit 84. Air 116 thus enters suction inlet 98 of first vacuum motor 94 and is exhausted from air outlet 100 of first vacuum motor 88. Air 116 is then carried through second conduit 102 to the suction inlet of second vacuum motor 108 and is expelled from air outlet 110 of second vacuum motor 108 through exhaust conduit 112 and muffler 114. Air 116 is eventually exhausted from muffler 114.

Muffler 114 advantageously serves to quiet the noise from first and second vacuum motors 94 and 108 by approximately 3 decibels (dB). By reducing the sound pressure level by 3 dB, the noise "dose" will be cut in half. Accordingly, a decrease of 3 dB significantly reduces the noise level experienced by the operator of apparatus 20 (FIG. 1) relative to prior vacuum extraction devices thereby reducing the potential for temporary and/or permanent hearing loss.

First outer surface 76 of clean fluid tank 26 further includes a first raceway portion 115 in the form of a molded indentation generally running from the top of first outer surface 76 to the bottom edge of first outer surface 76. Similarly, second outer surface 78 of waste fluid tank 30 further includes a second raceway portion 117 also generally running from the top of second outer surface 78 to the bottom edge of second outer surface 78. When second outer surface 78 of waste fluid tank 30 abuts first outer surface 76, first and second raceway portions 115 and 117, respectively, combine to form a raceway 118. A wiring harness 120 is positioned in raceway 118 during assembly of apparatus 20 (FIG. 1). Wiring harness 120 electrically couples control panel 56 with first and second vacuum motors 94 and 108, as well as the other internal mechanisms (discussed below) positioned in base 24 (FIG. 1).

The formation of conduit 84 and raceway 118 between first and second tanks and the integrally formed second conduit 102 decreases manufacturing and assembly costs relative to prior art devices due to a reduction in the number of discrete components. This reduction in the number of discrete components further results in a related advantage of lower maintenance costs, since there are less parts that have potential for failure.

Figure 11:
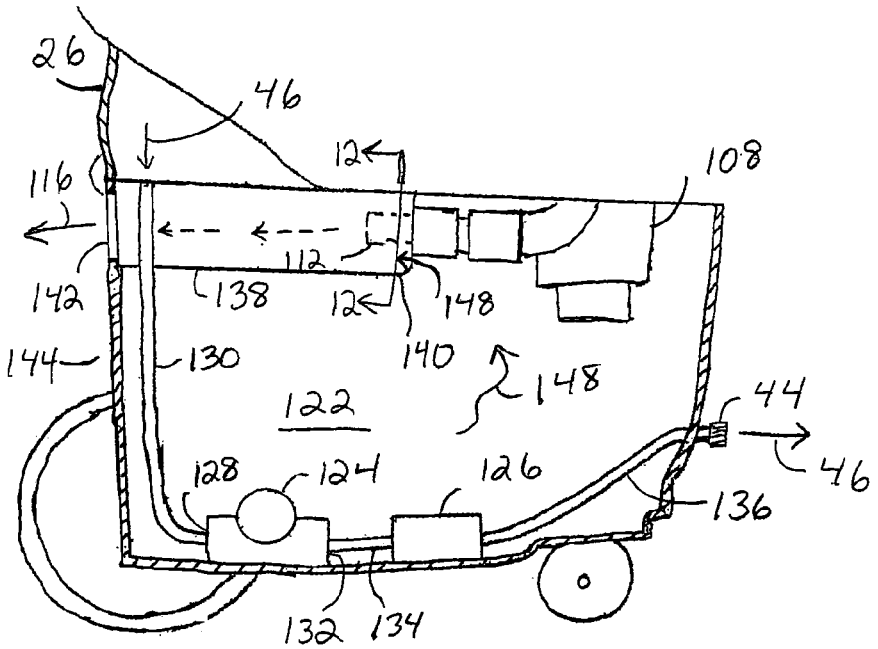
FIG. 11 shows a side sectional view of a base of the vacuum extraction apparatus illustrating the internal mechanisms thereof.

FIG. 11 shows a side sectional view of base 24 of vacuum extraction apparatus 20 (FIG. 1) illustrating the internal mechanisms thereof. Base 24 is substantially hollow, having a cavity 122 for housing the internal mechanisms of apparatus 20. When waste fluid tank 30 is coupled with clean fluid tank 26, and clean fluid tank 26 is seated on base 24 (as shown in FIGS. 1-2), first and second vacuum motors 94 and 108 reside inside of base 24. However, only second vacuum motor 108 is shown in FIG. 11 for clarity of illustration. First and second vacuum motors 94 and 108, mounted on respective first and second undersides 96 (FIG. 8) and 106 (FIG. 9) of clean fluid and waste fluid tanks 26 and 30, may be canted to reduce the depth in which motors 94 and 108 extend into cavity 122 of base 24. This saves space in cavity 122 so that sufficient volume is available for the other mechanisms positioned in base 24. In addition, it is desirable that second conduit 102 be kept as short as possible to achieve better suction between first and second vacuum motors 94 and 108, respectively. The canting of first and second vacuum motors 94 and 108 places air outlet 100 of first vacuum motor 94 closer to the suction inlet (not shown) of second vacuum motor 108 so that the length of second conduit 102 can be minimized.

Apparatus 20 (FIG. 1) further includes a fluid pump 124 located within cavity 122, and an optional in-line heater 126. Fluid pump 124 includes a pump inlet 128 in fluid communication with clean fluid tank 26 via a first feeder line 130. A pump outlet 132 is in fluid communication with in-line heater 126 via a second feeder line 134, and in-line heater 126 is in fluid communication with fluid delivery port 44 via a third feeder line 136. Accordingly, cleaning fluid 46 is directed from clean fluid tank 26 through fluid pump 124 and in-line heater 126, and exits apparatus 20 (FIG. 1) at fluid delivery port 44.

The temperature of cleaning fluid 46, the strength of the vacuum produced by first and second vacuum motors 94 and 108 operating in series, and the rate of delivery and discharge pressure of cleaning fluid 46 all contribute to the efficacy of the cleaning procedure performed by apparatus 20. Thus, apparatus 20 may be configured during manufacture of apparatus 20 to best suit the needs of the user. For example, apparatus 20 may be adapted to include only one vacuum motor, or more than two vacuum motors operating in series. Moreover, these vacuum motors may be single, dual, or three stage vacuum motors. By way of another example, fluid pump 124 may be configured to produce one of a number of discharge pressures, for example, 100, 300, 500, and 1200 psi. The optional in-line heater 126 can be included in apparatus 20 to rapidly heat the pumped cleaning fluid 46 before fluid 46 continues through fluid delivery port 44.

Figure 12:
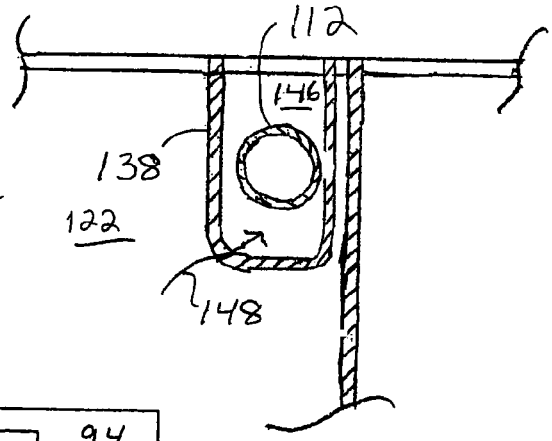
FIG. 12 shows a sectional view of a walled passage positioned in a cavity of the base along section lines 12-12 of FIG. 11.

Referring to FIG. 12 in connection with FIG. 11, FIG. 12 shows a sectional view of a walled passage 138 positioned in cavity 122 of base 24 along section lines 12-12 of FIG. 11. Walled passage 138 has an inlet 140 and an outlet 142 at an exterior surface 144 of base 24. A portion of exhaust conduit 112 (shown in ghost form in FIG. 11) resides within walled passage 138 at inlet 140 of walled passage 138. Air 116 is exhausted from apparatus 20 (FIG. 1) via outlet 142 of walled passage 138.

In a preferred embodiment, inlet 140 is larger than an outer diameter of exhaust conduit and exhaust conduit 112 fits loosely within walled passage 138, thus leaving space 146 surrounding conduit 112. As such as air 116 is exhausted from exhaust conduit 112, heated air, represented by an arrow 148, within cavity 122 is drawn into walled passage, where it mixes with air 116 and is exhausted from apparatus 20. Accordingly, no fan is needed to dissipate heat from cavity 122 of base 24, further reducing the noise produced by apparatus 20.

Figure 13:
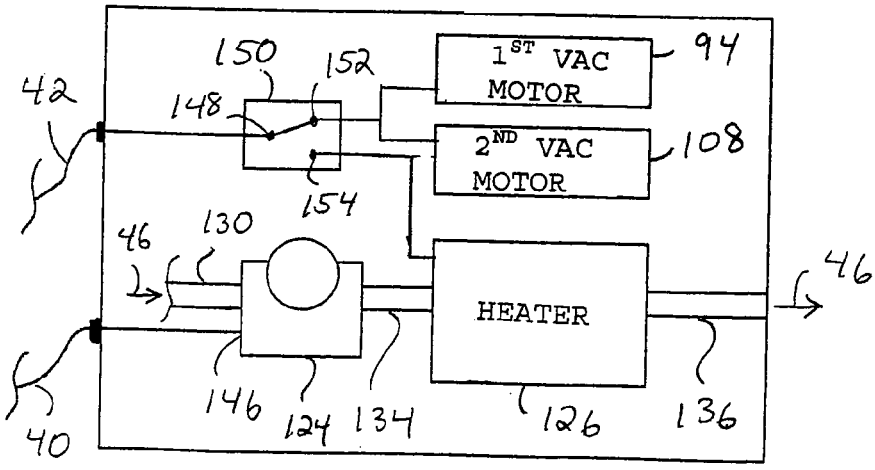
FIG. 13 shows a block diagram of the internal mechanisms located in the base of FIG. 11.

FIG. 13 shows a block diagram of the internal mechanisms located in base 24 (FIG. 11). First electrical cord 40 is electrically coupled to an electrical input 146 of fluid pump 124 for providing power from an external source, i.e., conventional wall power, to fluid pump 124. Second electrical cord 42 is electrically coupled to an electrical input 148 of a switch element 150. Power (preferably on a separate circuit from that which first electrical cord 40 is drawing power) is typically provided to first and second vacuum motors 94 and 108, respectively, when switch element 148 is set in a first switch position 152.

Figure 14:
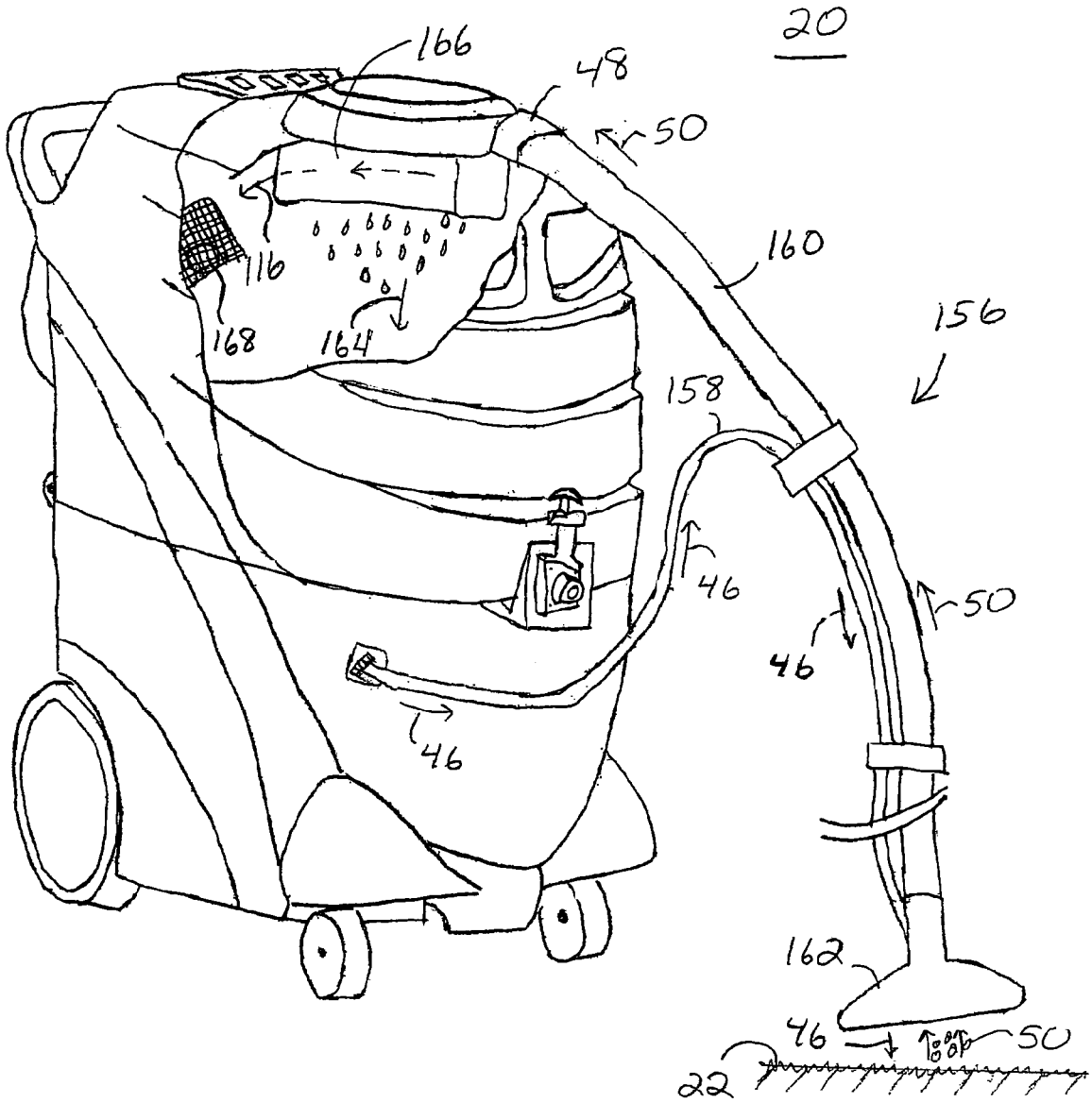
FIG. 14 shows a perspective view of the vacuum extraction apparatus with an attached hose assembly.

The operating protocol for a vacuum extraction apparatus calls for fluid pump 124 to be activated to spray cleaning fluid 46 onto surface 22 (FIG. 14). Fluid pump 124 is de-activated, and first and second vacuum motors 94 and 108 are then activated to vacuum the deposited cleaning fluid 46, along with soil entrained in fluid 46. As such, either pump 124 or vacuum motors 94 and 108 may be energized at any given instant, but not all at the same instant.

Switch element 150 switches to a second switch position 154 when first and second vacuum motors 94 and 108 are de-energized and pump 124 is energized. Second switch position 154 enables the power normally provided to first and second vacuum motors 94 and 108 to be diverted to in-line heater 126, thus energizing heater 126. Heater 126 may be provided with a dedicated power cord. When power is diverted from first and second vacuum motors 94 and 108 to heater 126 and is combined with the power provided from the dedicated power cord (for example, up to 15 Amps per cord), heater 126 can provide greater heating of fluid 46 for short intervals. Accordingly, the higher temperature fluid 46 can increase the cleaning efficacy of fluid 46. In one embodiment, switch element 150 may be a flow switch that switches to second switch position 154 when sufficient fluid flow is sensed in second feeder line 134. In another embodiment, switch element 150 may sense activation of fluid pump 124 to switch to second switch position 154. In yet another embodiment, switch element 150 may be manually controlled by an operator via control panel 56 (FIG. 1).

FIG. 14 shows a perspective view of vacuum extraction apparatus 20 with an attached hose assembly 156. Hose assembly 156 includes a cleaning fluid delivery hose 158 and a vacuum hose 160. A cleaning wand 162 is coupled to the ends of each of hoses 158 and 160. When fluid pump 124 (FIG. 11) is activated cleaning fluid 46 is delivered to surface 22 via cleaning fluid delivery hose 158 at cleaning wand 162. Conversely, when first and second vacuum motors 94 and 108 are activated mixture 50 of soiled fluid and air is drawn into cleaning wand 162 and vacuum hose 160.

Vacuum extraction apparatus 20 is shown partially cut away to reveal separation of the working air 116 from collected waste fluid 164. A baffle 166 is positioned at fluid inlet 48 of waste fluid tank 30. As mixture 50 is drawn into waste fluid tank 30, it is forced into a somewhat narrow passage between baffle 166 and an interior wall of waste fluid tank 30. This configuration of baffle 166 facilitates the separation of air 116 from waste fluid 164. Air 116 is subsequently drawn through a conventional screened float shut-off valve 168 and into conduit 84 (FIGS. 8-9), and waste fluid 164 drops into waste fluid tank 30. Of course, as known to those skilled in the art, the ball within valve 168 floats and seals tank outlet 92 (FIG. 9) when waste fluid tank 30 is full of waste fluid 164.

In summary, the present invention teaches of a vacuum extraction apparatus for cleaning a surface. The dual motors operating in series enable high powered vacuum extraction. The apparatus is durable and cost effectively manufactured through the minimization of discrete components. The number of discrete components is minimized by forming channels in mating surfaces of the clean fluid and waste fluid tanks that once assembled, form a conduit for the passage of air drawn into the waste tank by vacuum. Further advantages are achieved by the inclusion of a muffling device at an output of the vacuum motors and a venting configuration that eliminates the need for a noisy heat dissipating fan.

Although the preferred embodiments of the invention have been illustrated and described in detail, it will be readily apparent to those skilled in the art that various modifications may be made therein without departing from the spirit of the invention or from the scope of the appended claims. For example, the positions of the clean fluid and waste fluid tanks may be switched so that the waste fluid tank is located at the rear of the apparatus and is pivotally coupled to the base, and the cleaning fluid tank is located at the front of the apparatus and is coupled with the waste tank. In addition, the conduits formed by the abutment of the two tanks and/or integrally formed in one of the tanks can take a variety of forms and shapes commensurate with the specific shape of the tanks and the location of the vacuum motor or motors.

What is claimed is:

1. An apparatus for cleaning a surface comprising:

a first tank adapted to contain a fluid and configured for delivery of said fluid to said surface, said first tank including a first outer surface, and a first channel formed on said first outer surface;

a second tank coupled to said first tank and having a second outer surface and a second channel formed on said second outer surface, said second channel mating with said first channel to form a conduit between said first and second outer surfaces, said conduit being in fluid communication with said second tank; and a motor in communication with said conduit and configured to vacuum said fluid combined with air from said surface for receipt into said second tank, said air being expelled from said second tank via said conduit.

2. An apparatus as claimed in claim 1 further comprising an exhaust conduit in fluid communication with an air outlet of said motor for exhausting said air from said apparatus.

3. An apparatus as claimed in claim 2 wherein said exhaust conduit comprises a muffler.

4. An apparatus as claimed in claim 3 wherein said muffler is a non-restrictive muffler.

5. An apparatus as claimed in claim 2 further comprising a base to which said first tank is coupled, said base includes a cavity and a walled passage positioned in said cavity, said walled passage having an outlet at an outer surface of said base, and said exhaust conduit is in communication with said passage.

6. An apparatus as claimed in claim 1 wherein:

said motor is coupled on an underside of said first tank; and said apparatus further comprises a base to which said first tank is coupled, said base having a cavity within which said motor resides.

7. An apparatus as claimed in claim 1 further comprising:

a base to which said first tank is coupled, said base including a cavity; and a fluid pump located within said cavity, said fluid pump having a pump inlet in fluid communication with said first tank and a pump outlet in fluid communication with a fluid delivery port in said base, said fluid delivery port being adapted for attachment of a sprayer hose.

8. An apparatus as claimed in claim 7 further comprising a heater interposed between said first tank and said fluid delivery port.

9. An apparatus as claimed in claim 8 wherein said motor is configured to receive power from an external source, and said apparatus further comprises means for occasionally switching said power from said motor to said heater to energize said heater.

10. An apparatus as claimed in claim 1 wherein said second tank comprises a baffle positioned at a fluid inlet of said second tank.

11. An apparatus as claimed in claim 1 wherein said second tank comprises externally molded rib members.

12. An apparatus as claimed in claim 1 further comprising a tool compartment coupled to a back side of said first tank.

13. An apparatus for cleaning a surface comprising:

first tank adapted to contain a fluid and configured for delivery of said fluid to said surface, said first tank including a first outer surface;

a second tank coupled to said first tank and having a second outer surface, said second outer surface abutting said first outer surface to form a conduit between said first and second outer surfaces, said conduit being in fluid communication with said second tank;

a first motor coupled to a first underside of said first tank, said conduit being formed between an outlet of said second tank and an inlet of said first motor, said first motor being in communication with said conduit and configured to vacuum said fluid combined with air from said surface for receipt into said second tank, said air being expelled from said second tank via said conduit; and a second motor coupled to a second underside of said second tank, said second motor operating in series with said first motor.

14. An apparatus for cleaning a surface comprising:

a first tank adapted to contain a fluid and configured for delivery of said fluid to said surface, said first tank including a first outer surface;

a second tank coupled to said first tank and having a second outer surface, said second outer surface abutting said first outer surface to form a first conduit between said first and second outer surfaces, said first conduit being in fluid communication with said second tank;

a first motor in communication with said first conduit and configured to vacuum said fluid combined with air from said surface for receipt into said second tank, said air being expelled from said second tank via said first conduit;

a second motor operating in series with said first motor; and a second conduit interposed between an outlet of said first motor and an inlet of said second motor, said second conduit being integrally formed into one of said first and said second tanks.

15. An apparatus for cleaning a surface comprising:

a first tank adapted to contain a fluid and configured for delivery of said fluid to said surface, said first tank including a first outer surface;

a second tank coupled to said first tank and having a second outer surface, said second outer surface abutting said first outer surface to form a conduit between said first and second outer surfaces, said conduit being in fluid communication with said second tank;

a motor in communication with said conduit and configured to vacuum said fluid combined with air from said surface for receipt into said second tank, said air being expelled from said second tank via said conduit;

a control panel mounted on an outer surface of one of said first and second tanks; and a wiring harness electrically coupling said control panel with said motor, wherein abutment of said first and second outer surfaces yields a raceway in which said wiring harness is positioned.

16. An apparatus for cleaning a surface comprising:

a first tank adapted to contain a fluid and configured for delivery of said fluid to said surface, said first tank including a first outer surface;

a second tank coupled with said first tank and having a second outer surface, said second outer surface abutting said first outer surface to form a first conduit and a raceway between said first and second outer surfaces, said first conduit being in fluid communication with said second tank;

a first motor in communication with said conduit;

a second motor; and a second conduit interposed between an outlet of said first motor and an inlet of second motor, said second conduit being integrally formed in one of said first and said second tanks;

a control panel mounted on an outer surface of one of said first and second tanks; and a wiring harness positioned in said raceway and electrically coupling said control panel with said first and second motors, said first and second motors operating in series and configured to vacuum said fluid combined with air from said surface for receipt into said second tank, said air being expelled from said second tank via said conduit.

17. An apparatus as claimed in claim 16 wherein:

said first motor is coupled to a first underside of said first tank, said conduit being formed between an outlet of said second tank and an inlet of said first motor; and said second motor is coupled to a second underside of said second tank.

18. An apparatus as claimed in claim 16 further comprising a base to which said first tank is coupled, said base having a cavity within which said first and second motors reside.

* * * * *